US005697317A

United States Patent [19]

Pereira

[11] Patent Number: 5,697,317

[45] Date of Patent: Dec. 16, 1997

[54] HYDRO SKI

[76] Inventor: Fred A. Pereira, 73-1232 Ahikawa St., Kailua-Kona, Hi. 96740

[21] Appl. No.: 601,072

[22] Filed: Feb. 12, 1996

[51] Int. Cl.[6] ..... B63B 1/28

[52] U.S. Cl. ..... 114/270; 114/145 R; 114/281

[58] Field of Search ..... 114/270, 274, 114/279, 281, 145 R, 280, 284, 285; 440/77, 75, 67

[56] References Cited

U.S. PATENT DOCUMENTS

| | | | |
|---|---|---|---|
| 1,875,344 | 9/1932 | Kloen | 114/285 |
| 2,748,400 | 6/1956 | Kregall | 114/281 |
| 3,158,129 | 11/1964 | Mauer | 114/270 |
| 3,447,504 | 6/1969 | Shimanckas | 440/75 |
| 3,483,844 | 12/1969 | Trautwein | 115/70 |
| 3,610,713 | 10/1971 | Satterthwaite et al. | 440/67 |
| 3,756,189 | 9/1973 | Yutzler | 115/70 |
| 3,827,391 | 8/1974 | Stanberry, Sr. et al. | 114/274 |
| 3,948,206 | 4/1976 | Tyler | 115/70 |
| 4,387,661 | 6/1983 | Duff | 114/145 R |
| 5,113,777 | 5/1992 | Kobayashi | 114/144 R |

*Primary Examiner*—Sherman Basinger
*Attorney, Agent, or Firm*—Patent & Trademark Services; Joseph H. McGlynn

[57] ABSTRACT

A water craft having a motorcycle suspension which makes the craft more maneuverable and, therefore, safer to ride especially over rough and choppy water at high speeds. It also has plural flotation tanks to provide a margin of safety if one of the tanks is punctured. The water craft also has a rear brake spoiler to slow the craft down so the operator will not have to rely on the resistance of the water to bring the craft to a halt.

10 Claims, 3 Drawing Sheets

HYDRO SKI

BACKGROUND OF THE INVENTION

This invention relates, in general, to water craft and, in particular, to a water craft having a plurality of hydro skies for supporting the craft in the water and a motorcycle type suspension system.

DESCRIPTION OF THE PRIOR ART

In the prior art various types of water craft have been proposed. For example, U.S. Pat. No. 3,483,844 discloses a water craft having an articulated suspension so the craft can be tilted like a motorcycle for improved maneuvering. U.S. Pat. No. 3,756,189 discloses a water craft having a dual rudder system operated by the handlebars. U.S. Pat. No. 3,948,206 discloses a jet powered water craft in which the center of buoyancy is above its center of gravity so the craft will be self-righting.

However, all of the prior art water craft have numerous drawbacks. For example, the craft at high speed tend to be unstable due to a lack of of sufficient area of the craft in contact with the water at high speed. Also, all of the prior art devices lack a means for slowing the craft down, except turning off the throttle. Also, the prior art devices tend to have a single large flotation tank which will allow the craft to float if the engine dies. If this tank is punctured the craft will fill with water and sink.

SUMMARY OF THE INVENTION

The present invention solves all of the problems associated with the prior art. it consists of a water craft having a motorcycle suspension which makes the craft more maneuverable and therefore safer to ride, especially over rough and choppy water at high speeds. It also has plural flotation tanks to provide a margin of safety if one of the tanks is punctured. The water craft also has a rear brake spoiler to slow the craft down so the operator will not have to rely on the resistance of the water to bring the craft to a halt.

It is an object of the present invention to provide a new and improved water craft which is more maneuverable and therefore safer to ride, especially over rough and choppy water at high speeds.

It is an object of the present invention to provide a new and improved water craft which has extra flotation tanks to prevent the craft from sinking in case of an accident.

It is an object of the present invention to provide a new and improved water craft which has a rear brake spoiler to help slow or stop the craft.

These and other objects and advantages of the present invention will be fully apparent from the following description, when taken in connection with the annexed drawings.

DESCRIPTION OF THE PREFERRED EMBODIMENT

Figure 1:
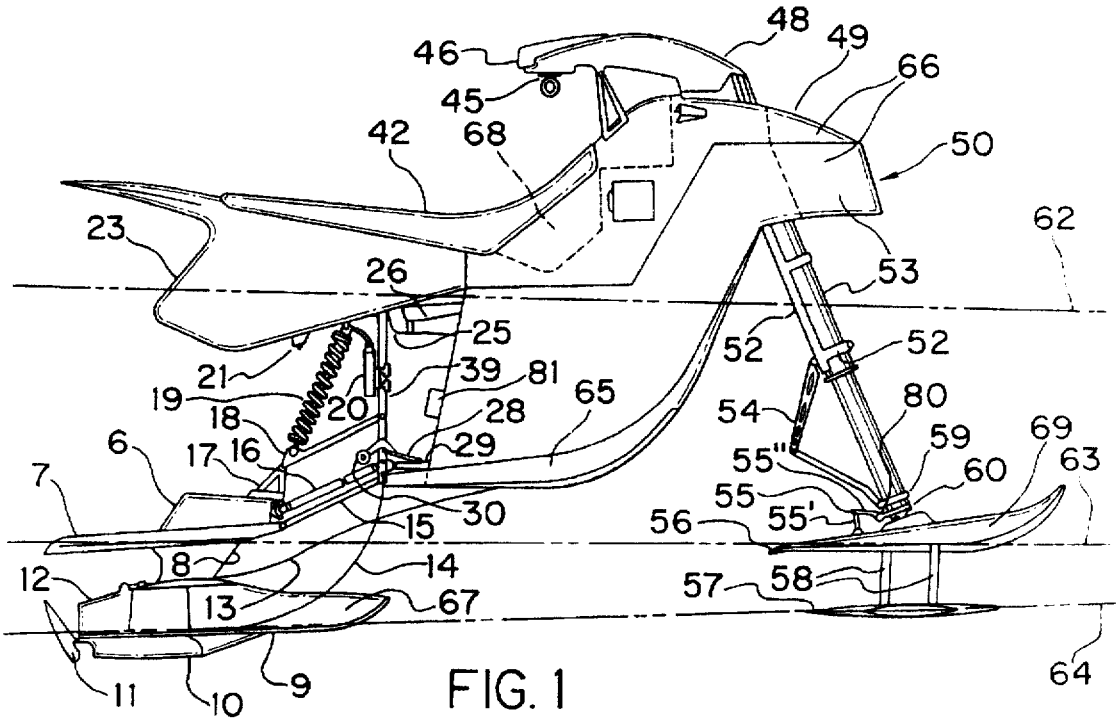
FIG. 1 is a side view of the present invention.

Referring now to the drawings in greater detail, FIG. 1 shows the water craft 1 of the present invention. The water comprises, generally, an elongated hull 50 with a hull cover 49, a front ski assembly comprises dual skies 56 and 57 with the skies located below and to the front of the hull 50. A strut assembly comprising a front fork 53, spring tension clamp 60 and spring tensioner 55 support the upper front ski 56. Attached to the bottom of the upper ski is a lower ski 57 attached by means of a pair of hydro ski arms 58. The spring tensioner 55 supports the front skies on the front fork 53 for pivotal movement of the skies about the longitudinal axis of the fork 53. Spring tensioner 55 is attached to the fork 53 by spring tension clamp 60 and is attached to the top of the ski by pivot bracket 62.

Figure 6:
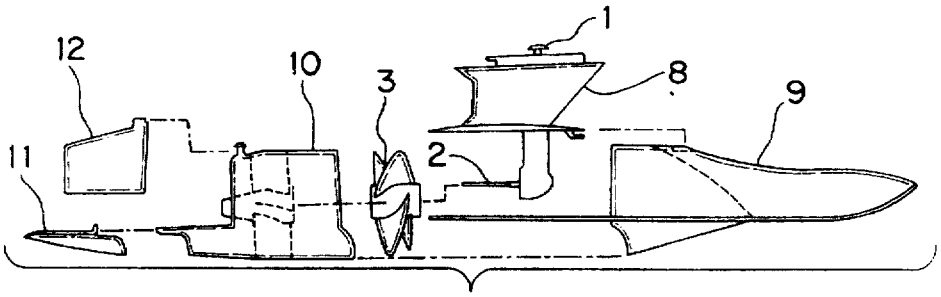
FIG. 6 is an exploded side view showing various components of the propulsion mechanism of the present invention.
Figure 7:
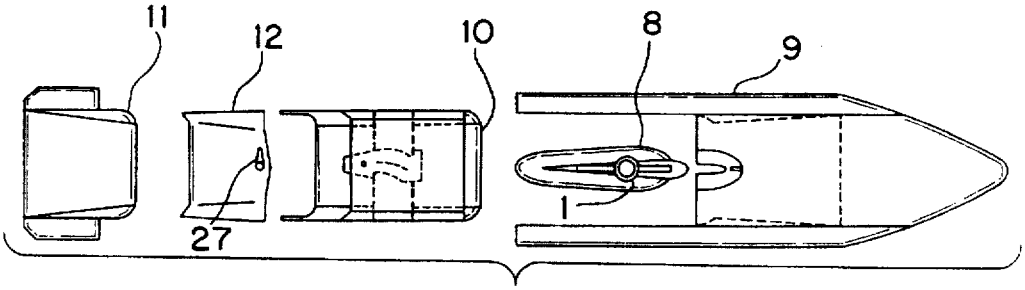
FIG. 7 is a top view of the present invention as shown in FIG. 6.

Also attached to the front fork by clamps 59 is an anti-torque link 54. Attached to the underside of fork 53 is a front fork braces 52. At the top of the water craft is a hull cover 49 which covers the top and extends partially down the side as shown in FIGS. 1 and 6. The cover gives the water craft a more aerodynamic design and helps to protect some of the mechanics of the craft.

Figure 2:
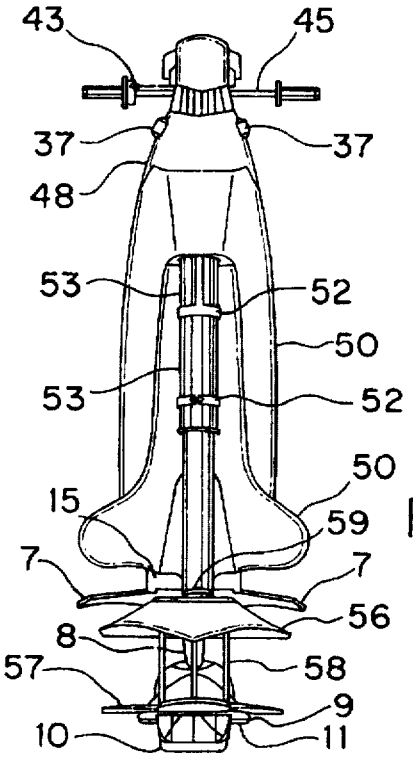
FIG. 2 is a top view of the present invention.

At the top of the craft is a steering column 48 (see FIG. 4) which extends down the center of the front fork and to which the handle bar 45 is attached, as shown in FIG. 2. The handle bar controls the direction the skies 56 and 57 are pointing in the same way a motorcycle handle bar controls the front wheel. Attached to the handle bar is a throttle control 43 which acts similar to a motorcycle throttle control. In the center of the handle bar is a pad 46 which is made of a waterproof material which is stuffed with a soft material such as, but not limited to, foam rubber to protect the chin of the rider during hard maneuvers or sudden stops.

Behind the handle bar 45 is a seat 42 for the rider, and beneath the seat and extending to the rear is a rear fender 23 which will help increase the aerodynamic shape of the craft. Beneath the rear fender is an exhaust hose which leads to the exhaust box 21. Also placed at the rear of the craft is a rear shock absorber 19, connected at the bottom by a upper arm 18 and at the top to a portion of the sub frame 39 of the water craft. Also attached to the sub frame is a nitrogen canister. 26. The rear shock absorber 19 is connected by means of a lower arm support 17 to the gear case cover 6. Beneath the gear case cover is the rear upper ski. 7, which is mounted on the steering nozzle 12 by means of the gear case 8. Mounted beneath the upper ski 7 is the lower rear ski 9, and behind this is the spoiler brake 11.

Figure 4:
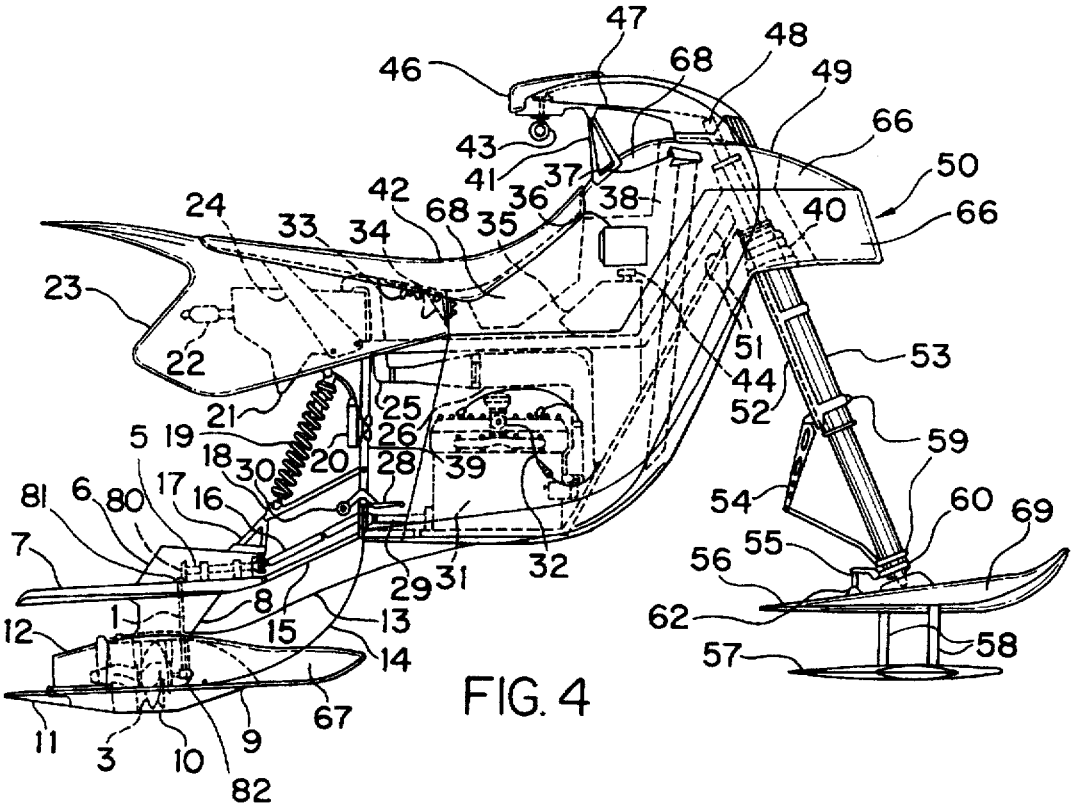
FIG. 4 is a side view of the present invention showing the location of various components in dotted lines.
Figure 5:
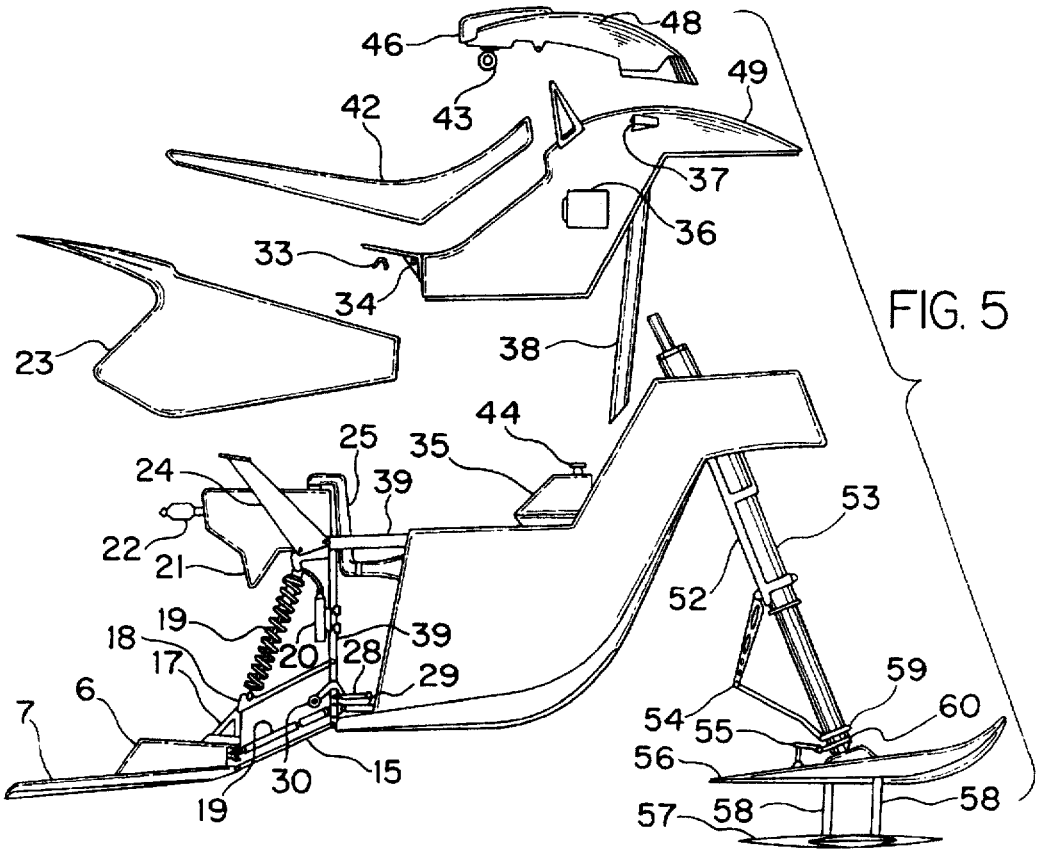
FIG. 5 is an exploded side view of the present invention.

Mounted beneath the seat 42 are the are the engine 31 and the various components associated therewith (see FIG. 4). For example, fuel line 32, fuel tank 35, air vent intake 37, and air vent nozzle 38. It should be noted that even though a specific type of engine has been shown in the drawings, the present invention is not limited to be used with any particular engine. Any type of engine may be used with the water craft including, but not limited to, a jet pump drive. Since the engine and its associated components are conventional, details respecting the same have been omitted for brevity.

The engine 31 will be connect to a propeller 3 by means of horizontal drive shaft 29, slide yoke drive shaft 16, horizontal drive shaft 5, and vertical drive shaft 1. The vertical drive shaft can be connected to the horizontal drive shaft 5 by any type of conventional gears 80,81 as shown in FIG. 4. In addition, the vertical drive shaft 1 can be connected to the prop 3 by any conventional connector 82. The engine 31 should be mounted low on the craft so the center of gravity is below the center of buoyancy to provide a self-righting characteristic to the water craft. In order to increase the buoyancy of the craft, and to insure against loss of buoyancy, a plurality of buoyancy compartments are distributed about the water craft. Because there are a plurality of compartments there will be a more even distribution of the weight of the craft and the buoyancy compartments which will make the craft more stable. Also, since the craft does not rely on a single buoyancy compartment, as do the prior art devices, it will not lose buoyancy if one of the compartments is punctured.

As shown in FIG. I the buoyancy compartments are 65 mounted at the lower portion of the hull cover 49, 66 mounted at the upper portion of the hull cover and in front of the handle bar 45, 67 which is a portion of the rear lower ski 9, 68 mounted beneath the seat 42 and 69 which is the upper front ski 56. All of the buoyancy compartments are filled with foam and sealed using any conventional means.

Attached to the handle bar 45 (see FIG. 4) is a pair of steering cables 47, and the other end of this cable is attached to the steering nozzle 12 surrounding the propeller 3. When the handle bar is turned to one side or the other the cable will pivot the steering nozzle which will change the direction of the water being forced to the rear of the craft by the propeller 3, which in turn will change the direction of the craft.

Figure 3:
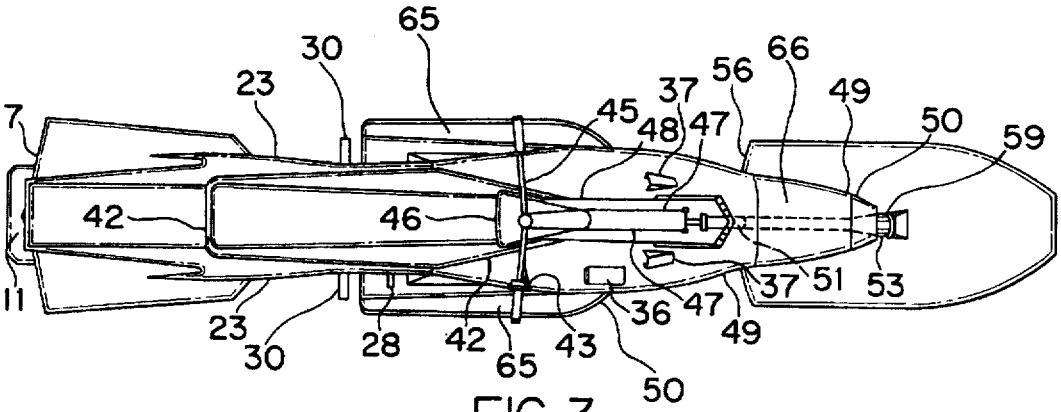
FIG. 3 is a top view of the present invention.

Attached to the spoiler brake 11 is a brake cable 14. The other end of the cable is attached to foot pedal 28 (see FIGS. 1 and 3). The spoiler brake 11 is normally in the position shown in FIG. 4, however when the rider presses on the brake lever 28 brake cable 14 will pull the spoiler into the position shown in FIG. 1. This will cause an increase in friction with the water and will decrease the speed of the craft. If the craft is hydroplaning at the time the spoiler is applied, it will kill the lift due to hydroplaning and the craft will lower into the water and assume a non-hydroplaning attitude. If the craft is not hydroplaning at the time the spoiler is applied, it will lower the speed of the craft or even stop it.

Shown in FIG. 1 is the three levels that the water craft will assume depending on the speed of the craft. The line 62 shows the position of the craft when it is stationary or moving very slowly in the water (below 5 mph). Line 63 shows the position of the craft in the water at 5–10 mph, and line 64 shows the position of the craft in the water at 15–80 mph. The speeds of the craft will, of course, vary depending on the weight of the rider or riders on the craft.

At rest or moving very slowly (below 5 mph) the water craft is buoyed by its hull and the multiple buoyancy compartments to the displacement position indicated by the waterline 62. The operator sits astride the seat 42 with his or her feet on the foot pegs 30. When the engine is started and the throttle is advanced it will rotate the propeller 3 through the means of the various drive shafts 1, 5, and 29. The rotation of the propeller and the discharge of water through steering nozzle 12 thrusts the water craft forward. As forward speed increases it will reach the point where the action of the water flowing against the undersides of the upper skies 7 and 56 hydrodynamically lifts the craft out of the water to the position indicated by waterline 63 in FIG. 1. As the speed increases further the action of the water flowing against the undersides of the lower skies 9 and 57 hydrodynamically lifts the craft out of the water to the position indicated by waterline 64 in FIG. 1.

During forward movement the vehicle can be turned by manipulating the handlebar 45 to rotate the steering shaft 48 within the front fork 53, which in turn rotates front skies 56 and 57. The spring tensioner 55 and anti torque link 54 together with the rear shock 19 enables the front skies and thus the water craft to accommodate itself to turning movements and any rough water conditions. Riding the water craft will be very similar to riding a motorcycle on land due to the above mentioned components, allowing the operator to lean into turns in order to maneuver the craft.

In order to slow down or stop the craft, the operator presses on brake lever 28 which lowers rear spoiler brake 11, which increases water drag which in turn slows the water craft.

Although the water craft and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A powered water craft comprising:

a hull including an engine, said water craft having a first position in the water when the water craft is at rest, steering means for enabling a user to change directions of said water craft, said steering means having a steering column thereto, a front ski assembly connected to said steering column, said front ski assembly including at least upper and lower front skis, each of said upper and lower front skis having a front portion on a front side of said steering column and a rear portion on a rear side of said steering column, said front ski assembly including means supporting said upper and lower front skis on said hull for pivotal movement about a steering axis in order to steer said water craft, said front ski assembly being supported by at least a pair of pivoted links, said links being attached between said rear side of said steering column and said rear portion of said front skies, a rear ski assembly underlying a rear portion of said hull and including at least upper and lower rear skis, said front ski assembly and said rear ski assembly cooperating to hydrodynamically lift said water craft to at least two cruise positions above said first position by virtue of relative water flow upon surfaces of said front and rear skis.

2. The powered water craft as claimed in claim 1, wherein said means supporting said upper and lower front skis on said hull for pivotal movement about a steering axis in order to steer said water craft includes a manually operated steering bar, said steering bar having a padded portion mounted approximately at a center of said steering bar for protecting an operator of said powered water craft.

3. The powered water craft as claimed in claim 2, wherein said manual steering bar has a pair of cables attached thereto, whereby turning said manual steering bar in one direction causes said water craft to turn in one direction and turning said manual steering bar in another direction causes said water craft to turn in said another direction.

4. The powered water craft as claimed in claim 2, wherein a steering nozzle is mounted at the rear of said water craft, means connecting said steering nozzle to said manual steering bar, whereby turning said manual steering bar in one direction causes said steering nozzle to turn in one direction and turning said manual steering bar in another direction causes said steering nozzle to turn in said another direction.

5. The powered water craft as claimed in claim 1, wherein said engine is connected to a prop by a series of drive shafts, said series of drive shafts comprising at least three drive shaft sections, a first one of said drive shaft sections connected to said engine, a second one of said drive shaft sections connected at one end to said first one of said drive shaft sections, and connected at another end to a third one of said drive shaft sections, said third one of said drive shaft sections has a gear connected on one end which engages a second gear which is connected to said prop.

6. The powered water craft as claimed in claim 5, wherein said second gear is covered by a gear case, a pump connected to said gear case, said rear ski assembly also connected to said gear case, mounted within said gear case is a vertical drive shaft which has a gear on one end which engages with said gear on said third one of said drive shaft sections, and a means for connecting said vertical drive shaft to said prop.

7. The powered water craft as claimed in claim 1, wherein said rear ski assembly is supported by an upper and lower arm which supports said rear ski assembly as it moves in an up and down motion.

8. The powered water craft as claimed in claim 1, wherein said means for supporting said upper and lower front skies includes a steering column, and a member extending parallel to said steering column, pivotable links connected to said member at one end and another end of said pivotal links connected to said front ski assembly.

9. The powered water craft of claim 1, wherein flotation means is mounted within at least said upper front ski and said lower rear ski, additional flotation means is mounted in a front of said hull, in a bottom portion of said hull and in an intermediate portion of said hull, all of said flotation means being independent from each other, whereby if one flotation means is damaged other flotation means will be able to maintain said water craft afloat.

10. The powered water craft as claimed in 9, wherein said flotation means are compartments filled with foam.

* * * * *